US006619266B2

(12) United States Patent
Koseki

(10) Patent No.: US 6,619,266 B2
(45) Date of Patent: Sep. 16, 2003

(54) CONTROL APPARATUS FOR ENGINE

(75) Inventor: Takahisa Koseki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 33 days.

(21) Appl. No.: 09/986,357

(22) Filed: Nov. 8, 2001

(65) Prior Publication Data

US 2002/0056442 A1 May 16, 2002

(30) Foreign Application Priority Data

Nov. 15, 2000 (JP) ..... 2000-347547

(51) Int. Cl.[7] ..... F02B 29/08
(52) U.S. Cl. ..... 123/478; 123/491
(58) Field of Search ..... 123/478, 480, 123/491; 701/105

(56) References Cited

U.S. PATENT DOCUMENTS 5,189,621 A * 2/1993 Onari et al. ..... 701/102
5,404,844 A * 4/1995 Schechter ..... 123/90.12
5,515,832 A * 5/1996 Bidner et al. ..... 123/568.14
5,542,394 A * 8/1996 Tomisawa ..... 123/491
5,826,564 A * 10/1998 Fuwa et al. ..... 123/491
5,870,994 A * 2/1999 Kato ..... 123/339.15
5,927,238 A * 7/1999 Watson ..... 123/90.15
6,062,201 A * 5/2000 Nozawa et al. ..... 123/478
6,092,496 A * 7/2000 Bhargava et al. ..... 123/90.15
6,161,511 A * 12/2000 Hashimoto ..... 123/90.15
6,328,007 B1 * 12/2001 Hirasawa et al. ..... 123/90.15
6,439,211 B1 * 8/2002 Juretzka et al. ..... 123/568.14

FOREIGN PATENT DOCUMENTS

JP 6-323168 A 11/1994
JP 06323168 A * 11/1994 ..... F02D/13/02

* cited by examiner

*Primary Examiner*—Willis R. Wolfe
*Assistant Examiner*—Douglas A. Salser
(74) *Attorney, Agent, or Firm*—Shinjyu Global IP Counselors, LLP.

(57) ABSTRACT

A control apparatus controls the opening and closing timings of the intake and exhaust valves and the fuel injection timing. When the water temperature of the engine is equal to or below a predetermined value, the exhaust valve closes before the top dead center, and the intake valve opens after the top dead center. At the same time, if the pressure inside the intake passage is equal to or below a predetermined value, the fuel injection is conducted during the intake process. Furthermore, the intake fuel injection timing is changed according to the rotational speed of the engine. In this manner, the vaporization of the injected fuel is promoted, and stability of the combustion is improved. Also the exhaust emission is improved, while the fuel consumption is reduced.

21 Claims, 6 Drawing Sheets

CONTROL APPARATUS FOR ENGINE

BACKGROUND OF THE INVENTION

1. Field of the Invention

The present invention relates to a control apparatus for an engine. More specifically, the present invention relates to a control apparatus for an engine that controls the opening and closing timings of the intake and exhaust valves and the fuel injection timing in order to promote vaporization of the fuel.

2. Background Information

When a cold engine is initially started and in a warm up operation, the fuel being injected from a fuel injection valve into an intake path cannot be vaporized easily because its temperature is low. Accordingly, the fuel stays in a liquid form and adheres to a wall surface of the intake path. Therefore, the fuel cannot be supplied to the combustion chamber in a stable manner. This results in unstable combustion of the fuel. Also, the discharge of HC in the exhausted emission increases. Furthermore, in order to compensate for the amount of fuel being injected as a liquid, the amount of fuel being injected has to be increased. Therefore, the amount of fuel consumption increases. To solve this problem, it has been proposed to use special fuel injection valves. For example, fuel injection valves having a porous plate or that inject fuel along with a part of the intake air that have been proposed.

On the other hand, in the technology disclosed in Japanese Laid-Open Patent Application Publication No. 6-323168, the open-valve timing of the intake valve is delayed while the engine is cold by using a variable valve timing apparatus that can freely control the opening and closing timings of the exhaust valve. In this manner, a pressure differential is generated between the combustion chamber and the intake path. By making the intake speed of the fuel high, the vaporization of the fuel is promoted.

In view of the above, there exists a need for an improved control apparatus for an engine that improves vaporization of fuel while overcoming the deficiencies in the prior art. This invention addresses this need in the art as well as other needs, which will become apparent to those skilled in the art from this disclosure.

SUMMARY OF THE INVENTION

In the technology disclosed in Japanese Laid-Open Patent Application Publication No. 6-323168, the above-mentioned pressure differential can be obtained at the time of cranking when the engine is started. However, after the negative pressure permeates inside the intake path, no differential pressure is generated between the combustion chamber and the intake path even when the open-valve timing of the intake valve is delayed. Therefore, the intake speed of the fuel cannot be increased. Accordingly, the effect of promoting the vaporization of the fuel does not last.

The present invention has been conceived in view of the above-described situation. The control apparatus of the present invention is designed to control the engine so as to prevent an increase in the discharge of HC in the exhaust emission, as well as prevent an increase in the fuel consumption. This is accomplished in the present invention by sustaining the promotion of vaporization of the injected fuel while the engine is being warmed up.

An aspect of the present invention is to provide a control apparatus for an engine comprising intake and exhaust passages fluidly coupled to a combustion chamber, an intake valve arranged to open and close the intake passage to the combustion chamber, an exhaust valve arranged to open and close the exhaust passage to the combustion chamber, and a fuel injection valve arranged to inject fuel into the intake passage. The intake valve is arranged to open and close the intake passage to the combustion chamber. The intake valve has opening and closing timings with the opening timing of the intake valve being set to open the intake valve after an exhaust top dead center such that a first crank angle is measured between the exhaust top dead center and the opening timing of the intake valve. The exhaust valve is arranged to open and close the exhaust passage to the combustion chamber. The exhaust valve has opening and closing timings with the closing timing of the exhaust valve being set to close the exhaust valve before an exhaust top dead center such that a second crank angle is measured between the closing timing of the exhaust valve and the exhaust top dead center. The second crank angle is greater than the first crank angle. The fuel injection valve is arranged to inject fuel into the intake passage. The fuel injection valve has a fuel injection timing set to inject fuel after opening of the intake valve.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
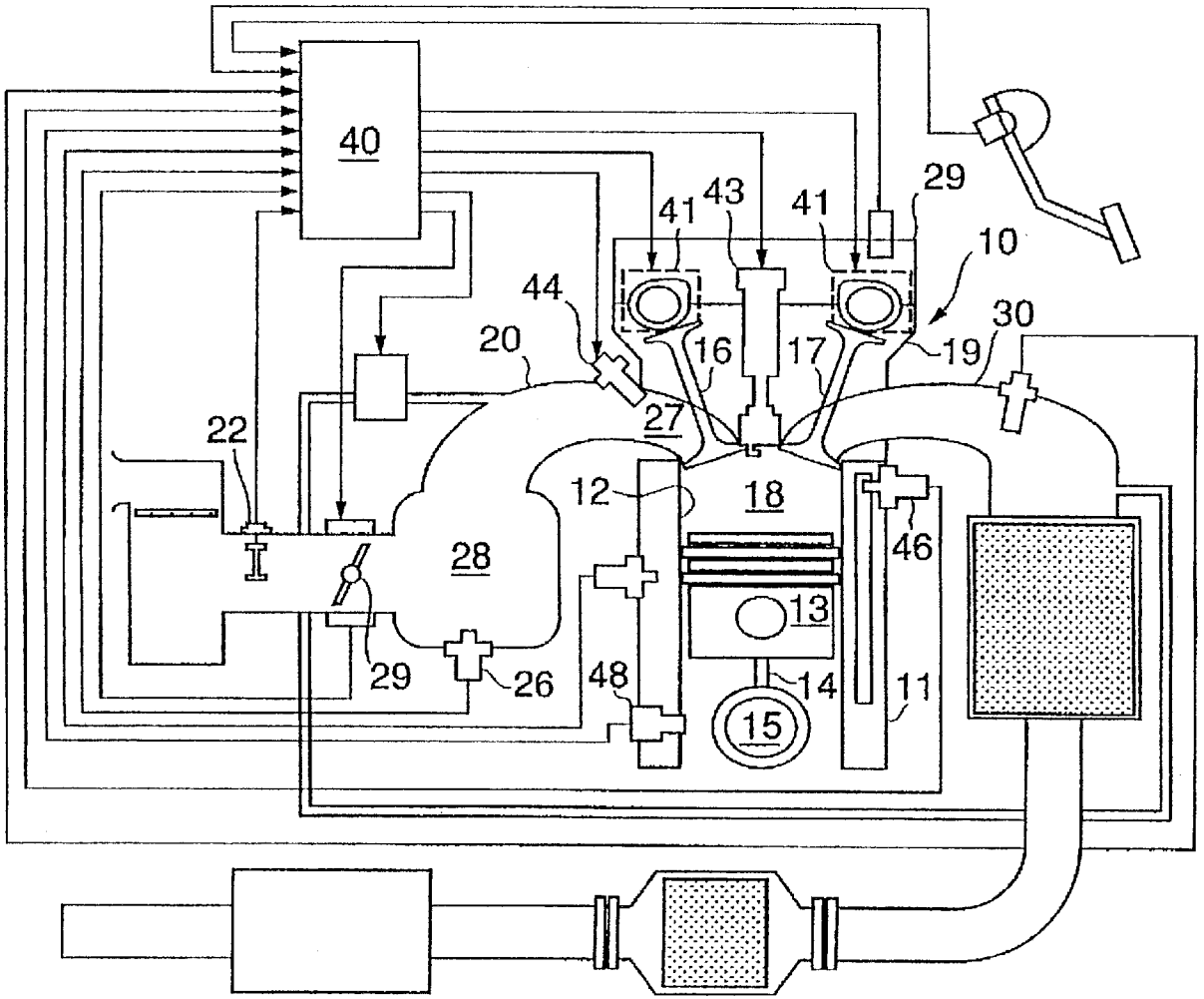
FIG. 1 is a diagrammatic illustration of an engine equipped with a valve control apparatus in accordance with one embodiment of the present invention.

An embodiment of the present invention will now be explained referring to FIGS. 1-6. FIG. 1 is a diagrammatic view of a multiple cylinder gasoline engine 10 mounted on a vehicle. The engine 10 has a cylinder block 11 with a predetermined number of cylinders 12 (only one shown)

disposed in parallel. Within each of the cylinders 12, a piston 13 is disposed for reciprocal movement. The pistons 13 are each connected to a crankshaft 15 by connecting rods 14 (only one shown). The reciprocating movements of the pistons 13 are converted to rotational movements by the connecting rods 14, so as to rotationally drive the crankshaft 15.

The cylinder block 11 is provided with a water temperature sensor 46 that detects the temperature of the cooling water, and a crank angle sensor 48 that detects the rotational speed of the engine 10 via the crankshaft 15.

A combustion chamber 18 is formed above each of the pistons 13 between the cylinder block 11 and a cylinder head 19. Each of the combustion chambers 18 has an ignition plug 43 disposed approximately on its center. Each combustion chamber 18 connects an intake passage 20 and an exhaust passage 30. The intake passage 20 and the exhaust passage 30 are disposed asymmetrically about the center of the cylinder 12.

The intake passage 20 is connected to or disconnected from the combustion chamber 18 by opening or closing the intake valve 16. The exhaust passage 30 is connected to or disconnected from the combustion chamber 18 by opening or closing the exhaust valve 17. The intake valves 16 and the exhaust valves 17 operate in sync with the crankshaft 15, so as to move in a reciprocating manner. On the other hand, the timings for the reciprocating movements of the intake valve 16 and the exhaust valve 17 (the timings for the reciprocating movements are hereinafter referred to as opening/closing timings) are freely determined by a variable valve timing device 41. An electronic control device or unit 40 electrically controls the variable valve timing device 41. The variable valve timing devices are conventional components that are well known in the art. Since variable valve timing devices are well known in the art, the variable valve timing device 41 will not be discussed or illustrated in detail herein.

Inside each intake passage 20 is disposed a fuel injection valve 44 that injects fuel based on the fuel injection timing controlled by the electronic control device 40. The injected fuel is directed toward the combustion chamber 18 where it is ignited in a conventional manner. The fuel injection timing of the fuel injection valve 44 is freely determined by the electronic control device 40 based on the driving state of the engine 10. The intake passages 20 are divided from a collector 28 toward each cylinder 12. On an upper stream side of the collector 28, a throttle valve 29 is disposed that controls the amount of air flowing into the collector 28. Also, an intake pressure sensor 26 is disposed in the collector 28 that detects the pressure of air intake. Furthermore, on the upper stream side of the throttle valve 29, an air flow meter 22 is disposed that detects the amount of air flowing in the collector 28.

Mixed gas of air and fuel injected from the fuel injection valve 44 enters into the combustion chamber 18 as the intake corresponding valve 16 opens. As the ignition plug 43 ignites the fuel in the combustion chamber 18, the gas expands and pushes the piston 13 down, thereby generating driving force. The combustion gas that has expanded is discharged to the exhaust passage 30 when the exhaust valve 17 opens.

The electronic control device 40 preferably includes a microcomputer with a control program that controls the opening/closing timings of the intake valves 16 and the exhaust valves 17 and the fuel injection timing of the fuel injection valve 44 as discussed below. The electronic control device 40 can also include other conventional components such as an input interface circuit, an output interface circuit, and storage devices such as a ROM (Read Only Memory) device and a RAM (Random Access Memory) device. The electronic control device 40 is operatively coupled to the variable valve timing device 41 and the fuel injection valve 44 in a conventional manner. The internal RAM and the internal ROM of the electronic control device 40 stores statuses of operational flags and various control data. The electronic control device 40 is capable of selectively controlling any of the components of the control apparatus in accordance with the control program. It will be apparent to those skilled in the art from this disclosure that the precise structure and algorithms for the electronic control device 40 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

Figure 2:
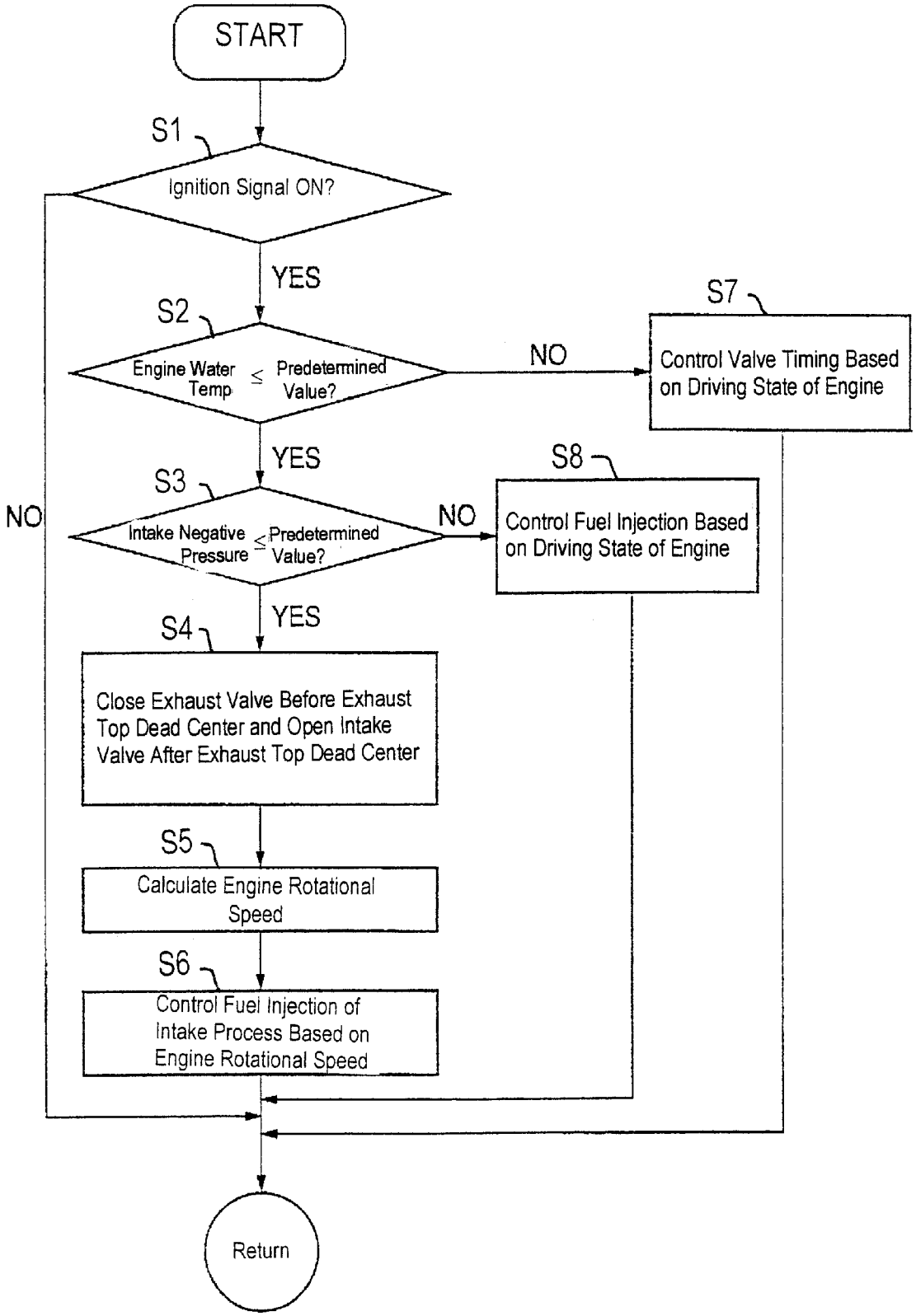
FIG. 2 is a flowchart of a control program for the valve control apparatus in accordance with the embodiment of the present invention illustrated in FIG. 1.
Figure 3:
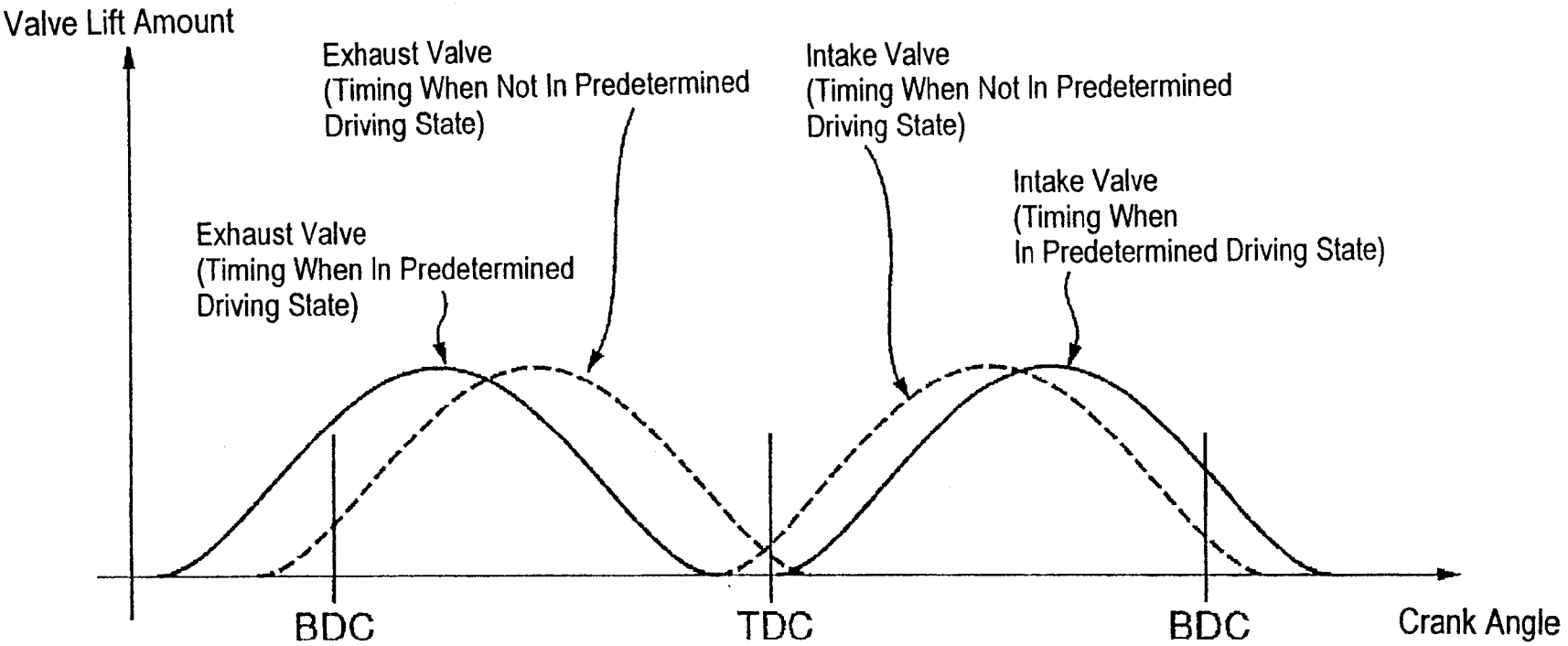
FIG. 3 is a graph showing the relationship between the crank angle and the valve lift amount of an intake valve and an exhaust valve in accordance with the present invention.

FIG. 2 shows a control flowchart of the control program for the electronic control device 40 of the engine 10 in accordance with one embodiment of the present invention. An explanation of the control program for the electronic control device 40 of the engine 10 follows below referring to the engine control flow chart shown in FIG. 2.

In step S1, the electronic control device 40 determines whether the ignition signal is ON or OFF, thereby determining whether the engine 10 is in a driving state. If the ignition signal is ON, the control program proceeds to step S2. If the ignition signal is OFF, the control program returns to the beginning to continuously repeat the control program at predetermined intervals.

In step S2, the temperature of the cooling water of the engine 10 is received by the electronic control device 40 from the water temperature sensor 46, and then the electronic control device 40 determines whether the cooling water temperature is equal to or below a predetermined value. For example, the predetermined value of the cooling water of the engine 10 is set to a value between about 30° C. to about 40° C. The electronic control device 40 determines that the engine 10 is in a predetermined driving state, if the cooling water temperature is equal to or below a predetermined value (about 30° C. to about 40° C.). In other words, if the temperature of the cooling water of the engine 10 is equal to or below the predetermined value the electronic control device 40 determines that the engine 10 is in the predetermined driving state. Therefore, the control program proceeds to step S3. However, if the temperature of the cooling water of the engine 10 is greater than the predetermined value, the electronic control device 40 determines that the engine 10 is not in the predetermined driving state. Accordingly, the control program proceeds to step S7.

Thus in step S2, while the engine 10 is warmed up, it is determined that there is a problem with the vaporization of the fuel. Accordingly, vaporization of the fuel can be promoted. On the other hand, after the engine is warmed up, and when vaporization of the fuel is unnecessary, if there is a request for output, the valve opening and closing timings and the fuel injection timing can be controlled for the purpose of increasing the output.

In step S3, the status of the negative pressure generated in a fuel injection field 27 of the engine 10 is received by the electronic control device 40 from the intake pressure sensor 26 in order to determine whether the engine 10 is in the predetermined driving state. Thus, the intake pressure is detected, and the electronic control device 40 determines whether the intake pressure is equal to or below a predetermined value. For example, the intake pressure is set to a value between about 30 kPA (abs) to about 40 kPA (abs). In other words, the electronic control device 40 determines whether the engine 10 is in a predetermined driving state, e.g., the intake pressure is equal to or below a predetermined value (about 30 kPA (abs) to about 40 kPA (abs)). In this embodiment, the pressure of the fuel injection field 27 is directly detected through the output of the intake pressure sensor 26 disposed in the collector 28. If the pressure in the fuel injection fuel field 27 is equal to or below a predetermined pressure value (about 30 kPA (abs) to about 40 kPA (abs)), then the electronic control device 40 determines that the engine 10 is in the predetermined driving state. Accordingly, the control proceeds to step S4. If the pressure of the fuel injection field 27 is greater than the predetermined value, the electronic control device 40 determines that the engine 10 is not in the predetermined driving state. Therefore, the control program proceeds to step S8. In the case where a vehicle that does not have the intake pressure sensor 26, the status of negative pressure generated in the fuel injection field 27 can be determined by detecting a basic injection pulse.

In step S4, since the engine 10 is in the predetermined driving state in which the promotion of the vaporization of the fuel is necessary, the electronic control device 40 controls the opening and closing timings of the intake valve 16 and the exhaust valve 17 with the variable valve timing device 41. In other words, as seen in the solid line in FIG. 3, the closing timing of the exhaust valve 17 is set to close the exhaust valve 17 before the exhaust top dead center, and the opening timing of the intake valve is set to open after the exhaust top dead center (TDC). Additionally, the crank angle between the exhaust top dead center and the opening timing of the intake valve 16 is set to be smaller than the crank angle between the closing timing of the exhaust valve 17 and the exhaust top dead center. In other words, the opening and closing timings are set such that there is no valve overlap period.

Accordingly, since the exhaust valve 17 closes before the top dead center, a portion of the combustion gas remains in the combustion chamber 18 to be compressed. The crank angle between the closing timing of the exhaust valve 17 and the exhaust top dead center is greater than the crank angle between the exhaust top dead center and the opening timing of the intake valve 16. Therefore, after the exhaust top dead center, once the intake valve 16 is opened, the compressed combustion gas is blown into the intake passage 20 through the intake valve 16. Accordingly, the pressure increases rapidly. However, since the piston 13 moves downward and proceeds to the intake process, a negative pressure is generated quickly in the fuel injection field 27. Since this growth of the negative pressure surpasses the low pressure boiling starting pressure, the fuel can be adequately vaporized in the fuel injection field 27. By conducting the fuel injection during the intake process at a time approximately when the negative pressure is minimum, the vaporization of the fuel can be promoted. Also, since the combustion gas is temporarily discharged to the intake passage, the temperature in the fuel injection field increases. Therefore, the vaporization of the fuel can be further promoted.

Since the vaporization of the injected fuel is promoted as described above, the combustion at the engine 10 becomes stable, and the HC concentration in the exhaust emission decreases. Accordingly, it is possible to prevent reduction of the engine output. Also, since the injected fuel does not adhere to the intake passage in the liquid state, there is no need to inject additional fuel to compensate for the liquid adhered fuel. Therefore, it is possible to prevent an increase in the fuel consumption amount.

In step S5, the rotational speed of the engine 10 is detected in order to determine the fuel injection timing. The electronic control apparatus 40 calculates the rotational speed of the engine 10 based on the output from a crank angle sensor 48. Then the control program proceeds to step S6.

In step S6, since the engine 10 is in the predetermined driving state in which the promotion of the vaporization of the fuel is necessary, the fuel injection is performed in the intake process based on the rotational speed of the engine calculated in step S5. The relationship between the rotational speed of the engine 10 and the fuel injection timing is as follows. That is, the crank angle at which the negative pressure is most permeated in the fuel injection field 27 tends to shift to an advanced angle side as the rotational speed of the engine increases. Accordingly, as the rotational speed of the engine 10 increases, the timing of fuel injection, which is after the exhaust top dead center, is shifted toward the advanced angle side based on the graph in FIG. 6. With the aforementioned control program, by detecting the pressure inside the intake passage, it is possible to determine the low load state of the engine. Accordingly, it is possible to control the valve opening and closing timings and the fuel injection timing.

In step S7, since the driving state of the engine 10 is not the predetermined driving state, the variable valve timing device 41 freely sets the opening and closing timings of the intake valve 16 and the exhaust valve 17 based on the normal opening and closing timings stored in the electronic control device 40 for the current driving state of the engine 10. More specifically, as shown in the broken lines in FIG. 3, the exhaust valve 17 opens before the expansion bottom dead center (BDC), and closes after the exhaust top dead center (TDC). On the other hand, the intake valve 16 opens before the exhaust top dead center, and closes after the intake bottom dead center. In other words, the opening and closing timings of the intake valve 16 and the exhaust valve 17 are basically such that there is a valve overlap period. Besides, the opening and closing timings of the intake valve 16 and the exhaust valve 17 being determined freely based on the driving state of the engine 10, the opening and closing timings of the intake valve 16 and the exhaust valve 17 can be controlled based on the fuel injection amount and the rotational speed of the engine 10. After step S7, the control program returns to the beginning to continuously repeat the control program at predetermined intervals.

In step S8, the fuel injection control program that is stored in the electronic control device 40 controls the exhaust process based on the driving state of the engine 10. For instance, the fuel injection control program controls the exhaust process based on the fuel injection amount and the rotational speed of the engine 10. In particular, the fuel injection valve 44 is adjustably controlled by the electronic control device 40 to change the fuel injection timing. The fuel injection amount being injected from the fuel injection valve 44 is measured by the electronic control device 40 to determine the load state of the engine 10. Specifically, it is determined that the load state of the engine 10 is a low load state when the fuel injection amount is equal to or below a predetermined fuel injection amount, e.g., 5–20 mg per cylinder for each cycle. Thus, the electronic control device 40 acts as an engine driving state detection device that detects a fuel injection amount from the fuel injection valve 44 as the load state of the engine 10. The electronic control device 40 also acts as an engine driving state determination device that determines the load state of the engine 10 is a low load state when the fuel injection amount is equal to or below a predetermined fuel injection amount, i.e., corresponds to a predetermined driving state. Thus, the electronic control device 40 adjusts the fuel injection timing to a normal fuel injection timing that corresponds to the driving state of the engine 10 when the driving state of the engine 10 does not corresponds to the predetermined driving state. After step S8, the control program returns to the beginning to continuously repeat the control program at predetermined intervals.

With this control program, after the engine is warmed up, it is determined whether there is a problem with the vaporization of the fuel. Furthermore, since the vaporization is promoted when the engine load is low, if there is a request for output, the valve opening and closing timings and the fuel injection timing can be controlled for the purpose of increasing the output.

Figure 4:
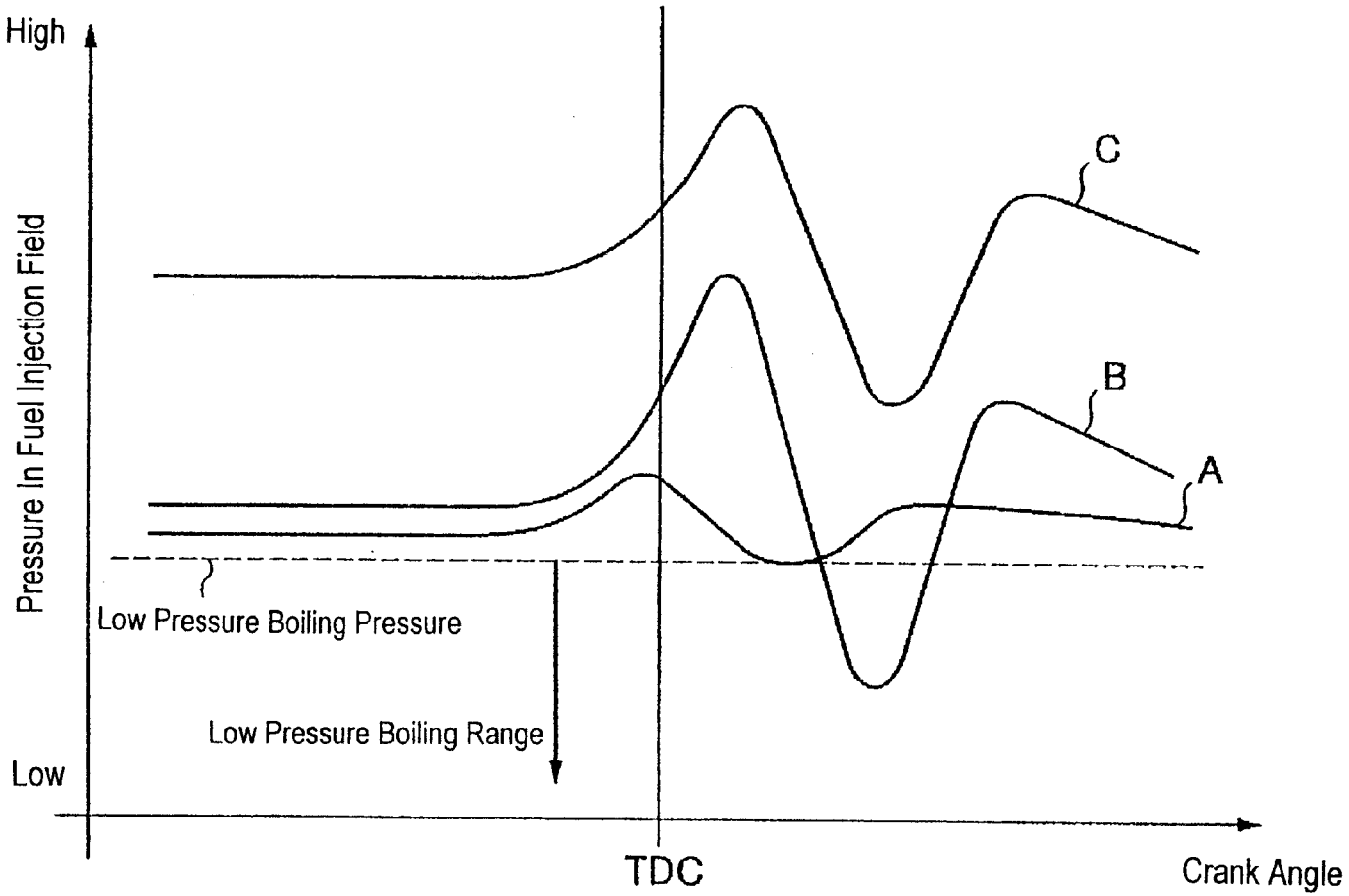
FIG. 4 is a graph showing the relationship between the crank angle and the pressure in the fuel injection field formed inside the intake passage.

Advantageous effects of the embodiment of the invention will now be explained referring to FIGS. 4 and 5. FIG. 4 is a graph that shows the relationship between the crank angle and the pressure in the fuel injection field 27 of the intake passage 20. In the solid line B of FIG. 4, the engine 10 is in a low load state with the exhaust valve 17 closing before the exhaust top dead center, and the intake valve 16 opening after the exhaust top dead center. In other words, solid line B shows a case where there is no valve overlap period. In the solid line A of FIG. 4, the engine 10 is in a low load state with the exhaust valve 17 closing after the exhaust top dead center, and the intake valve 16 opening before the exhaust top dead center. In other words, solid line A shows a case where there is a valve overlap period. In the solid line C of FIG. 4, the engine 10 is in a high load state with the exhaust valve 17 closes before the exhaust top dead center, and the intake valve 16 opening after the exhaust top dead center. In other words, the solid line C shows a case where there is no valve overlap period. The broken line in FIG. 4 indicates a low pressure boiling pressure, which is the maximum pressure at which the fuel can be boiled due to the low pressure occurring in the fuel injection field 27. Below the broken line in FIG. 4, the vaporization of the fuel can be promoted due to low pressure boiling. Above the broken line, the fuel cannot be boiled at low pressure. Therefore, no promotion of vaporization occurs.

Figure 5:
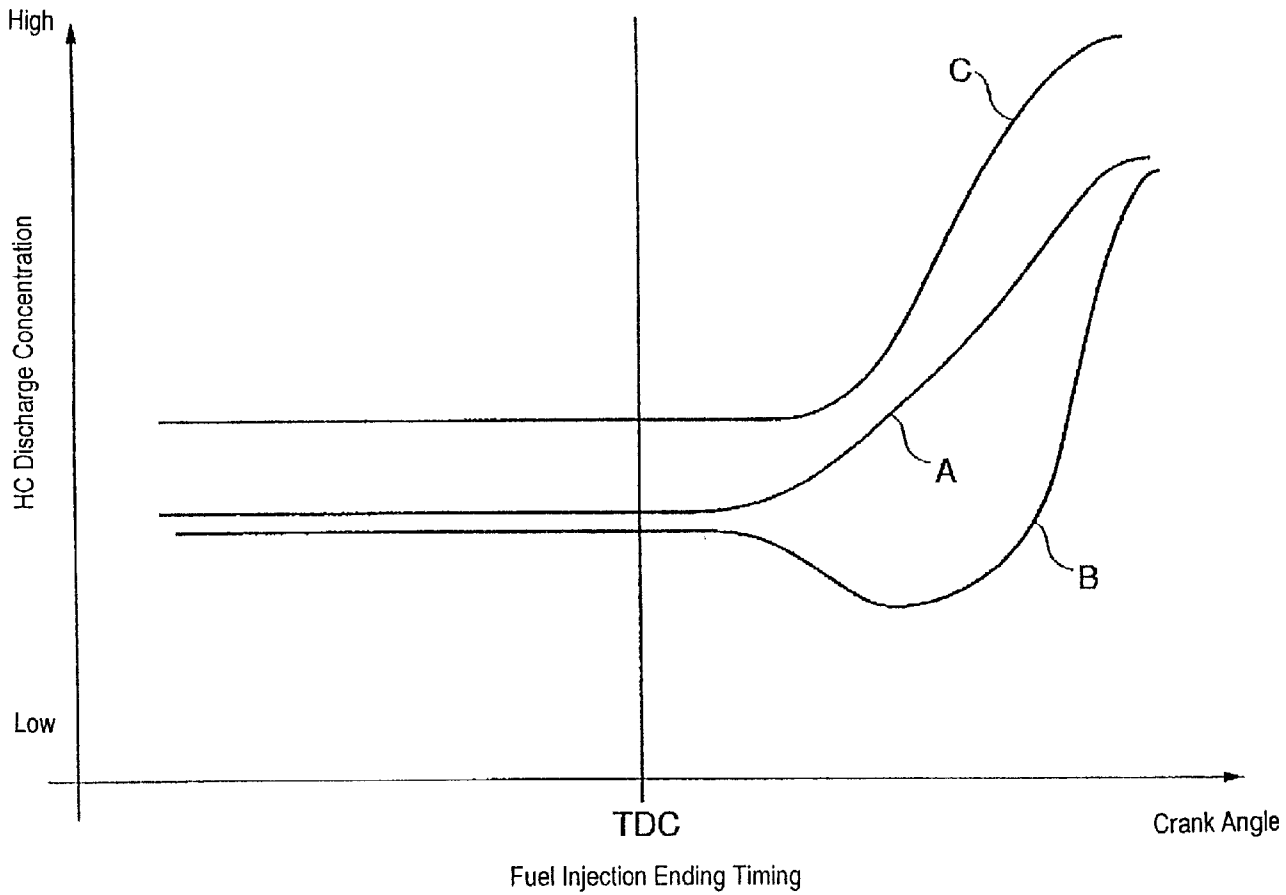
FIG. 5 is a graph showing the relationship between the crank angle and HC discharge concentration in the combustion gas.

FIG. 5 is a graph showing the relationship between the fuel injection ending timing and the HC exhaust concentration with reference to the exhaust top dead center. In the solid line A of FIG. 5, the engine 10 is in a low load state with the exhaust valve 17 closing after the exhaust top dead center, and the intake valve 16 opening before the exhaust top dead center. In other words, the solid line A shows a case where there is a valve overlap period. In the solid line B of FIG. 5, the engine 10 is in a low load state with the exhaust valve 17 closing before the exhaust top dead center, and the intake valve 16 opening after the exhaust top dead center. In other words, the solid line B shows a case where there is no valve overlap period. In the solid line C of FIG. 5, the engine 10 is in a high load state with the exhaust valve 17 closing before the exhaust top dead center, and the intake valve 16 opening after the exhaust top dead center. In other words, the solid line C shows a case where there is no valve overlap period.

According to the solid line B of FIG. 4, since the exhaust valve 17 closes before the exhaust top dead center, a portion of the combustion gas remains in the combustion chamber 18 and becomes compressed. The crank angle between the closing point of the exhaust valve 17 and the top dead center is set to be greater than the crank angle between the top dead center and the opening point of the intake valve 16. Accordingly, after the exhaust top dead center, the intake valve 16 opens, and then the compressed combustion gas is instantaneously and temporarily blown into the intake passage 20 through the intake valve 16. Accordingly, the pressure rapidly increases in the intake passage 20. However, since the piston 13 goes down and proceeds to the intake process instantaneously, a negative pressure is quickly developed in the fuel injection field 27 of the intake passage 20. Since this growth of the negative pressure exceeds the low pressure boiling pressure, the fuel can be properly vaporized in the fuel injection field 27. By injecting the fuel during the intake process when the negative pressure is at the minimum, the vaporization of the fuel can be promoted. Since the period during which the negative pressure is minimum substantially coincides with the period during which the intake valve 16 opens, the fuel needs to be injected when the intake valve 16 opens. Also, since the combustion gas is temporarily discharged into the intake passage 20, the temperature in the fuel injection field 27 increases. Accordingly, the vaporization of the fuel is further promoted.

As described above, since the vaporization of the fuel is promoted, the combustion in the engine 10 becomes more stable. Accordingly, it is possible to prevent lowering of the engine output. Accordingly, as seen in the solid line B of FIG. 5, it is possible to lower the HC concentration in the emitted combustion gas. Also, since the injected fuel does not adhere to the intake passage 20 in the liquid state, there is no need to inject additional fuel in order to compensate for the adhered liquid fuel. Accordingly, the amount of fuel consumption does not have to be increased. Furthermore, there is no need to promote vaporization of the fuel by utilizing a special fuel injection valve such as a fuel injection valve having a porous plate or a fuel injection valve that injects fuel with a portion of air intake.

Figure 6:
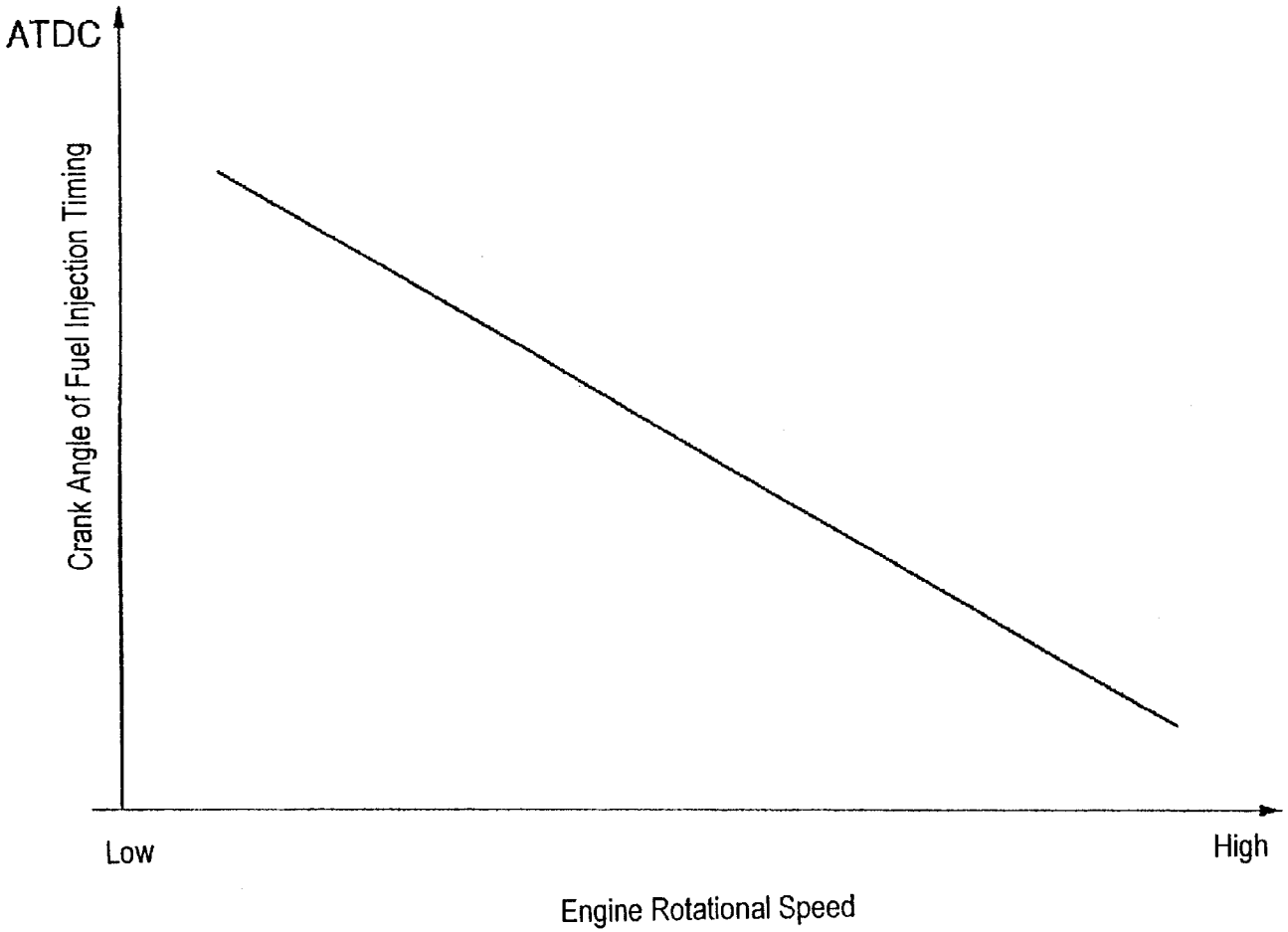
FIG. 6 is a graph showing the relationship between the rotational speed of the engine and the crank angle at which negative pressure inside the intake passage becomes minimum.

Additionally, when the fuel injection occurs during the intake process, the fuel injection timing is advanced to the time when the negative pressure occurs in the fuel injection field 27, which changes in response to the rotational speed of the engine 10, as seen in FIG. 6. In this manner, the vaporization of the fuel is promoted. The above-described effects can be further increased.

On the other hand, the solid line A in FIG. 4 shows a case where the exhaust valve 17 closes after the exhaust top dead center, and the intake valve 16 opens before the exhaust top dead center. In this case, the change in the pressure within the intake passage 20 is small compared to the solid line B in FIG. 4. Also, the pressure in the fuel injection field 27 of the intake passage 20 does not reach the pressure at which low pressure boiling occurs. Accordingly, the vaporization of the fuel is not promoted. Also in this case, as seen in the solid line A of FIG. 5, the vaporization of the fuel is not promoted as compared with the solid line B in FIG. 5. Therefore, the injected fuel is adhered to the intake passage 20 in the liquid state. Accordingly, the combustion becomes unstable, and the HC concentration in the combustion gas increases. Since the fuel becomes adhered to the intake passage 20 in the liquid state, the fuel consumption amount has to be increased to compensate for the adhered liquid fuel. This leads to an increase in the fuel consumption amount.

By setting the crank angle between the closing point of the exhaust valve 17 and the exhaust top dead center greater than the crank angle between the exhaust top dead center and the opening point of the intake valve 16, and by conducting the fuel injection during the intake process, the vaporization of the injected fuel can be promoted. Accordingly, the combustion in the engine 10 becomes stable. The HC concentration in the exhaust emission becomes lower. Furthermore, the lowering of the engine output can be prevented. Also, since the injected fuel does not adhere to the intake passage 20 in the liquid state, there is no need to inject additional fuel in order to compensate for the adhered liquid fuel. Therefore, it is possible to prevent an increase in the fuel consumption amount.

The solid line C in FIG. 4 shows a case where the exhaust valve 17 closes before the exhaust top dead center and the intake valve 16 opens after the exhaust top dead center. The engine 10 is in the high load state. Although the level of pressure change in the intake passage 20 is approximately the same as that of the case of solid line B in FIG. 5, since the engine 10 is in the high load state, the pressure does not decrease to the pressure at which the fuel boils due to low pressure. Therefore, the vaporization of the fuel is not promoted. Therefore, as seen in solid line C of FIG. 5, even if the fuel is injected during the intake process, the vaporization of the fuel is not promoted. The injected fuel becomes adhered to the intake passage 20 in the liquid state. Accordingly, the combustion becomes unstable. The HC concentration in the combustion gas also increases. Also, since the fuel is adhered to the intake passage 20 in the liquid state, the amount of fuel injection has to be increased in order to compensate for the fuel that is adhered in the liquid state. Accordingly, the amount of fuel consumption increases.

In this invention, if the driving state of the engine is not the predetermined driving state, the fuel injection is performed during the exhaust process. In other words, since the fuel injection timing can be freely set based on the fuel injection amount and the rotational speed of the engine, promotion of the vaporization of the fuel is not compromised. The vaporization of the fuel is sustained, and therefore the combustion becomes stable. The present invention also prevents an increase in the discharge of HC in the exhaust emission. At the same time, an increase in the fuel consumption amount can be prevented.

With the aforementioned structure, even when there is no means to detect the pressure inside the intake passage, it is possible to determine the load state of the engine. Accordingly, it is possible to control the valve opening and closing timings and the fuel injection timing.

Furthermore, the variable valve timing device 42 can freely set the opening and closing timings of the intake valve 16 and the exhaust valve 17 based on the driving state (e.g., low load state, cooling water temperature or intake pressure) of the engine 10. For instance, since the opening and closing timings of the intake valve 16 and the exhaust valve 17 can be freely set based on the fuel injection amount and the rotational speed of the engine, the fuel consumption amount can be reduced, and the engine output can be improved.

With the aforementioned structure, when the driving state of the engine 10 does not correspond to the predetermined driving state, the variable valve timing device 42 switches to normal valve opening and closing timings that correspond to the driving state of the engine 10. For instance, when there is a request for output, it is possible to control the valve opening and closing timings and the fuel injection timing for the purpose of increasing the output.

With the aforementioned structure, when the driving state of the engine 10 does not correspond to the predetermined driving state, the fuel injection timing of the fuel injection valve 44 switches to the normal fuel injection timing that corresponds to the driving state of the engine. For instance, when there is a request for output, the valve opening and closing timings and the fuel injection timing are controlled for the purpose of increasing the output.

The term "configured" as used herein to describe a component, section or part of a device includes hardware and/or software that is constructed and/or programmed to carry out the desired function. As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2000-347547. The entire disclosure of Japanese Patent Application No. 2000-347547 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A control apparatus for an engine, comprising:

intake and exhaust passages fluidly coupled to a combustion chamber;

an intake valve arranged to open and close intake passage to the combustion chamber, the intake valve having opening and closing timings with the opening timing of the intake valve being set to open the intake valve after an exhaust top dead center such that a first crank angle is measured between the exhaust top dead center and the opening timing of the intake valve;

an exhaust valve arranged to open and close the exhaust passage to the combustion chamber, the exhaust valve having opening and closing timings with the closing timing of the exhaust valve being set to close the exhaust valve before an exhaust top dead center such that a second crank angle is measured between the closing timing of the exhaust valve and the exhaust top dead center the second crank angle being greater than the first crank angle; and a fuel injection valve arranged to inject fuel into the intake passage, the fuel injection valve having a fuel injection timing set to inject fuel after opening of the intake valve.

2. The control apparatus as set forth in claim 1, further comprising:

an engine driving state detection device arranged to detect a driving state of the engine;

an engine driving state determination device arranged to determine whether the driving state of the engine is a predetermined driving state; and a variable valve timing device arranged to change the opening and closing timings of the intake valve and the exhaust valve based on the driving state of the engine as determined by engine driving state determination device;

the closing timing of the exhaust valve being set by the variable valve timing device to close the exhaust valve before an exhaust top dead center when the engine driving state determination device determines that the driving state of the engine corresponds to predetermined driving state, and the closing timing of the exhaust valve being normally set by the variable valve timing device to close the exhaust valve after the exhaust top dead center when the engine driving state determination device determines that the driving state of the engine does not corresponds to the predetermined driving state, the opening timing of the intake valve being set by the variable valve timing device to open the intake valve after an exhaust top dead center when the engine driving state determination device determines that the driving state of the engine corresponds to the predetermined driving state, and the opening timing of the intake valve being normally set by the variable valve timing device to open the intake valve before the exhaust top dead center when the engine driving state determination device determines that the driving state of the engine does not corresponds to the predetermined driving state, the second crank angle being set by the variable valve timing device to be greater than the first crank when the engine driving state determination device determines that the driving state of the engine corresponds to the predetermined driving state, and the fuel injection timing of the fuel injection valve being set by the variable valve timing device to inject fuel after opening of the intake valve when the engine driving state determination device determines that the driving state of the engine corresponds to the predetermined driving state.

3. The control apparatus as set forth in claim 2, wherein the engine driving state detection device detects at least a temperature that relates to a temperature of the engine and the engine driving state determination device determines that the driving state of the engine corresponds to the predetermined state when the detected temperature is equal to or below a predetermined temperature.

4. The control apparatus as set forth in claim 2, wherein the engine driving state detection device detects at least a load state of the engine and a temperature that relates to a temperature of the engine, and the engine driving state determination device determines that the driving state of the engine corresponds to the predetermined state when the detected temperature is equal to or below a predetermined temperature and the load state of the engine indicates a low load.

5. The control apparatus as set forth in claim 4, wherein the engine driving state detection device further detects a pressure inside the intake passage as the load state of the engine, and the engine driving state determination device determines that the load state of the engine is the low load state when the pressure inside the intake passage is equal to or below a predetermined pressure.

6. The control apparatus as set forth in claim 4, wherein the engine driving state detection device further detects a fuel injection amount from the fuel injection valve as the load state of the engine, and the engine driving state determination device determines that the load state of the engine is the low load state when the fuel injection amount is equal to or below a predetermined fuel injection amount.

7. The control apparatus as set forth in claim 2, wherein the fuel injection valve is adjustable to set the fuel injection timing to a normal fuel injection timing that corresponds to the driving state of the engine when the driving state of the engine does not corresponds to the predetermined driving state.

8. The control apparatus as set forth in claim 2, wherein the engine driving state detection device is an engine rotational speed detection device arranged to detect a rotational speed of the engine, and the fuel injection valve being adjustable to set the fuel injection timing based on the rotational speed of the engine detected by the engine rotational speed detection device when the driving state of the engine as detected by the engine rotational speed detection device corresponds to the predetermined driving state.

9. The control apparatus as set forth in claim 8, wherein the fuel injection valve is configured to further advance the fuel injection timing as the rotational speed of the engine detected by the engine rotational speed detection device becomes greater.

10. The control apparatus as set forth in claim 1, wherein the fuel injection timing of the fuel injection valve is set to correspond to a timing at which a pressure in a fuel injection field becomes negative due to opening of the intake valve.

11. The control apparatus as set forth in claim 10, further comprising:

an engine driving state detection device arranged to detect a driving state of the engine;

an engine driving state determination device arranged to determine whether the driving state of the engine is a predetermined driving state; and a variable valve timing device arranged to change the opening and closing timings of the intake valve and the exhaust valve based on the driving state of the engine as determined by the engine driving state determination device;

the closing timing of the exhaust valve being set by the variable valve timing device to close the exhaust valve before an exhaust top dead center when the engine driving state determination device determines that the driving state of the engine corresponds to the predetermined driving state, and the closing timing of said the exhaust valve being normally set by the variable valve timing device to close the exhaust valve after the exhaust top dead center when the engine driving state determination device determines that the driving state of the engine does not corresponds to the predetermined driving state, the opening timing of the intake valve being set by the variable valve timing device to open the intake valve after an exhaust top dead center when the engine driving state determination device determines that the driving state of the engine corresponds to the predetermined driving state, and the opening timing of the intake valve being normally set by the variable valve timing device to open the intake valve before the exhaust top dead center when the engine driving state determination device determines that the driving state of the engine does not corresponds to the predetermined driving state, the second crank angle being set by the variable valve timing device to be greater than the first crank when the engine driving state determination device determines that the driving state of the engine corresponds to the predetermined driving state, and the fuel injection timing of the fuel injection valve being set by the variable valve timing device to inject fuel after opening of the intake valve when the engine driving state determination device determines that the driving state of the engine corresponds to the predetermined driving state.

12. The control apparatus as set forth in claim 11, wherein the engine driving state detection device detects at least a temperature that relates to a temperature of the engine, and the engine driving state determination device determines that the driving state of the engine corresponds to the predetermined state when the detected temperature is equal to or below a predetermined temperature.

13. The control apparatus as set forth in claim 11, wherein the engine driving state detection device detects at least a load state of the engine and a temperature that relates to a temperature of the engine, and the engine driving state determination device determines that the driving state of the engine corresponds to the predetermined state when the detected temperature is equal to or below a predetermined temperature and the load state of the engine indicates a low load.

14. The control apparatus as set forth in claim 13, wherein the engine driving state detection device further detects a pressure inside the intake passage as the load state of the engine, and the engine driving state determination device determines that the load state of the engine is the low load state when pressure inside the intake passage is equal to or below a predetermined pressure.

15. The control apparatus as set forth in claim 13, wherein the engine driving state detection device further detects a fuel injection amount from the fuel injection valve as the load state of the engine, and the engine driving state determination device determines that the load state of the engine is the low load state when the fuel injection amount is equal to or below a predetermined fuel injection amount.

16. The control apparatus as set forth in claim 11, wherein the fuel injection valve is adjustable to set the fuel injection timing to a normal fuel injection timing that corresponds to the driving state of the engine when the driving state of the engine does not corresponds to the predetermined driving state.

17. The control apparatus as set forth in claim 11, wherein the engine driving state detection device is an engine rotational speed detection device arranged to detect a rotational speed of the engine, and the fuel injection valve being adjustable to set the fuel injection timing based on the rotational speed of the engine detected by the engine rotational speed detection device when the driving state of the engine as detected by the engine rotational speed detection device corresponds to the predetermined driving state.

18. The control apparatus as set forth in claim 17, wherein the fuel injection valve is configured to further advance the fuel injection timing as the rotational speed of the engine detected by the engine rotational speed detection device becomes greater.

19. A control apparatus for an engine, comprising:

intake valve timing means for controlling opening and closing timings of an intake valve with the opening timing of the intake valve being set to open the intake valve after an exhaust top dead center such that a first crank angle is measured between the exhaust top dead center and the opening timing of the intake valve;

exhaust valve timing means for controlling opening and closing timings of an exhaust valve with the closing timing of the exhaust valve being set to close the exhaust valve before an exhaust top dead center such that a second crank angle is measured between the closing timing of the exhaust valve and the exhaust top dead center, the second crank angle being greater than the first crank angle; and fuel injection timing means for controlling injection of fuel into an intake passage after opening of the intake valve.

20. The control apparatus as set forth in claim 19, wherein the fuel injection timing means is set to correspond to a timing at which a pressure in a fuel injection field becomes negative due to opening of the intake valve.

21. The control apparatus as set forth in claim 20, further comprising:

engine driving state detection means for detecting a driving state of the engine;

engine driving state determination means for determining whether the driving state of the engine is a predetermined driving state; and variable valve timing means for changing the opening and closing timings of the intake valve and the exhaust valve based on the driving state of the engine as determined by the engine driving state determination means;

the closing timing of the exhaust valve being set by the variable valve timing means to close the exhaust valve before an exhaust top dead center when the engine driving state determination means determines that the driving state of the engine corresponds to the predetermined driving state, and the closing timing of the exhaust valve being normally set by the variable valve timing means to close the exhaust valve after the exhaust top dead center when the engine driving state determination means determines that the driving state of the engine does not corresponds to the predetermined driving state, the opening timing of the intake valve being set by the variable valve timing means to open the intake valve after an exhaust top dead center when the engine driving state determination means determines that the driving state of the engine corresponds to the predetermined driving state, and the opening timing of the intake valve being normally set by the variable valve timing means to open the intake valve before the exhaust top dead center when the engine driving state determination means determines that the driving state of the engine does not corresponds to the predetermined driving state, the second crank angle being set by the variable valve timing means to be greater than the first crank when the engine driving state determination means determines that the driving state of the engine corresponds to the predetermined driving state, and the fuel injection timing means being set to inject fuel after opening of the intake valve when the engine driving state determination means determines that the driving state of the engine corresponds to predetermined driving state.

* * * * *